US006604840B2

(12) United States Patent
Watson

(10) Patent No.: US 6,604,840 B2
(45) Date of Patent: Aug. 12, 2003

(54) LIGHTING APPARATUS FOR A SIGN

(76) Inventor: Marion H. Watson, 4601 County Rd. 351, Fulton, MO (US) 65251-5149

( * ) Notice: Subject to any disclaimer, the term of this patent is extended or adjusted under 35 U.S.C. 154(b) by 6 days.

(21) Appl. No.: 09/995,381

(22) Filed: Nov. 27, 2001

(65) Prior Publication Data

US 2003/0099105 A1 May 29, 2003

(51) Int. Cl.[7] ..... F21V 21/00

(52) U.S. Cl. ..... 362/249; 362/183; 362/812; 40/541; 40/575

(58) Field of Search ..... 362/183, 249, 362/812; 40/575, 464, 541

(56) References Cited

U.S. PATENT DOCUMENTS 4,009,535 A 3/1977 Stock
4,947,300 A 8/1990 Wen
5,192,944 A 3/1993 Otsuki et al.
5,309,656 A * 5/1994 Montgomery ..... 40/442
5,435,087 A 7/1995 Karkar et al.
5,573,328 A 11/1996 Hwang
5,729,924 A * 3/1998 Reading ..... 40/564
6,023,869 A * 2/2000 Durbin ..... 40/544
6,131,321 A 10/2000 Daigle, Jr.
6,263,601 B1 7/2001 Emert

* cited by examiner

*Primary Examiner*—Sandra O'Shea
*Assistant Examiner*—Ronald E. DelGizzi
(74) *Attorney, Agent, or Firm*—Dale J. Ream

(57) ABSTRACT

A lighting apparatus for use with a name plate sign includes an elongate frame having a planar bottom with an upper portion defining an interior space. The frame bottom includes a bracket for attachment to the name plate. A rechargeable battery is mounted within the interior space of the frame and is electrically connected to a plurality of light sources depending from the frame bottom. A thin film solar panel is positioned atop the upper frame portion and is electrically connected to the battery to repeatedly recharge it as the panel collects solar energy. A photoelectric light sensor is mounted to the frame and permits current to flow from the battery to the light sources when a sensed level of ambient light is less than a predetermined level. Therefore, the name plate is illuminated when insufficient ambient light is available.

20 Claims, 6 Drawing Sheets

LIGHTING APPARATUS FOR A SIGN

BACKGROUND OF THE INVENTION

This invention relates generally to illuminated sign assemblies and, more particularly, to a lighting apparatus which can illuminate a name plate of a sign when ambient light is insufficient and using solar energized light sources.

It is often difficult for a motorist to read road signs and street intersection signs when driving at night or even at dusk. Many intersections have no artificial lighting whatsoever or the artificial lighting is not positioned so as to illuminate the name plate of a street sign.

Various illuminated signs have been proposed in the art. These devices generally include house address sign housings with related lighting elements or include complete commercial lighted signage panels. Although assumably effective for their intended purposes, existing devices do not provide a lighting apparatus for releasable use with a street intersection sign and which illuminates the name plate of such a sign when ambient light is inadequate and which uses solar energy so as to minimize maintenance.

Therefore, it is desirable to have a lighting apparatus which may be releasably mounted to a name plate of a street intersection sign. Further, it is desirable to have a lighting apparatus which only illuminates an intersection sign when ambient light is inadequate. In addition, it is desirable to have a lighting apparatus which is solar powered such that the power source of such an apparatus need not be regularly replaced by municipal workers.

SUMMARY OF THE INVENTION

A lighting apparatus for use with a street sign of the type having an indicia plate or name plate includes an elongate frame member having a bottom with an upper portion integral thereto which defines an interior space. A bracket having a pair of spaced apart plates is attached perpendicularly to the frame bottom and is configured such that the name plate of a street sign may be sandwiched therebetween. The bracket may be releasably attached to a street sign with a conventional fastener such as a bolt and nut combination. Therefore, the lighting apparatus frame may be coupled to existing street intersection signage or coupled to such signage at the point of manufacture. A rechargeable battery is positioned within the interior space and may be accessed via a slidable battery drawer. A plurality of light sources, such as light emitting diodes, are attached to the frame bottom on either side of the bracket and are each electrically connected to the battery for illuminating the name plate. A solar panel is positioned atop the upper portion of the frame and is electrically connected to the battery for providing a trickle charge thereto as solar energy is collected so as to repeatedly recharge the battery. A photoelectric light sensor is mounted to the frame for sensing a level of ambient light. This sensor is also electrically connected to the battery for permitting current to flow from the battery to the lights when a sensed level of light is less than a predetermined level.

Therefore, a general object of this invention is to provide a lighting apparatus that may be releasably attached to street intersection signs.

Another object of this invention is to provide a lighting apparatus, as aforesaid, which may illuminate the name plate of a street intersection sign to which it is attached.

Still another object of this invention is to provide a lighting apparatus, as aforesaid, which utilizes a rechargeable battery to energize a plurality of lights.

Yet another object of this invention is to provide a lighting apparatus, as aforesaid, having a thin film solar panel for repeatedly recharging the battery as solar energy is collected.

A further object of this invention is to provide a lighting apparatus, as aforesaid, which permits current to energize the lights only when an ambient light level is less than a predetermined level.

A still further object of this invention is to provide a lighting apparatus, as aforesaid, which requires minimal maintenance.

Another object of this invention is to provide a lighting apparatus, as aforesaid, which is simple and inexpensive to manufacture.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
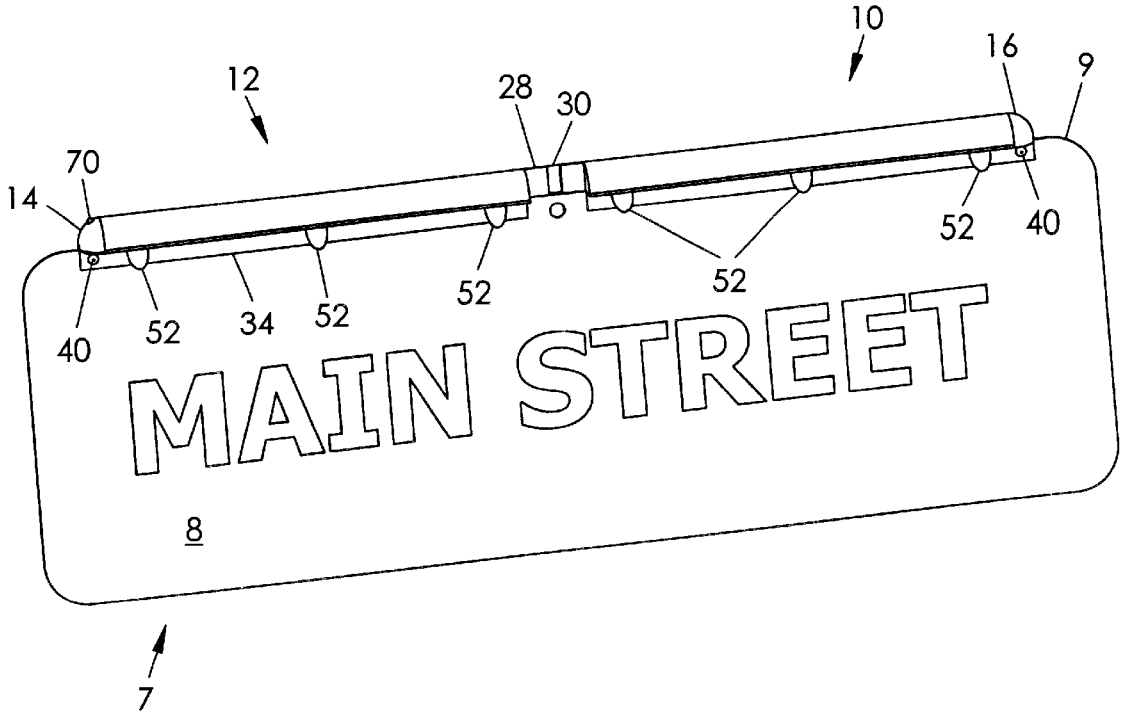
FIG. 1 is a perspective view of a lighting apparatus according to one embodiment of the present invention installed upon a street identification sign.
Figure 2A:
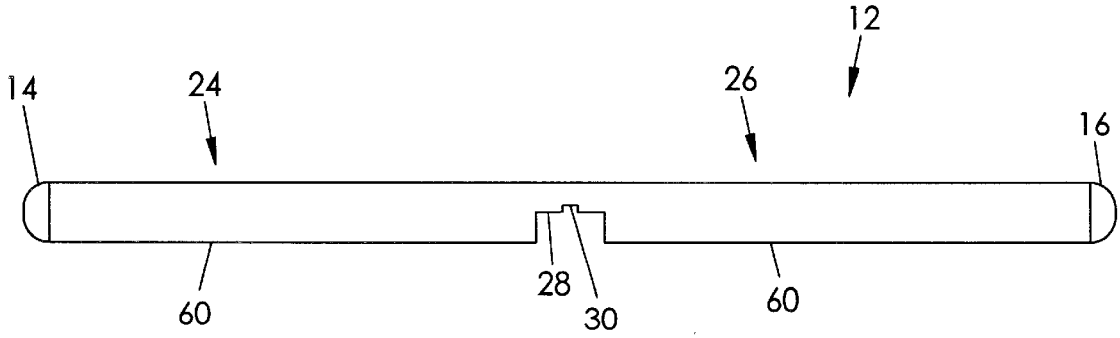
FIG. 2*a* is a top view of the lighting apparatus as in FIG. 1.
Figure 2B:
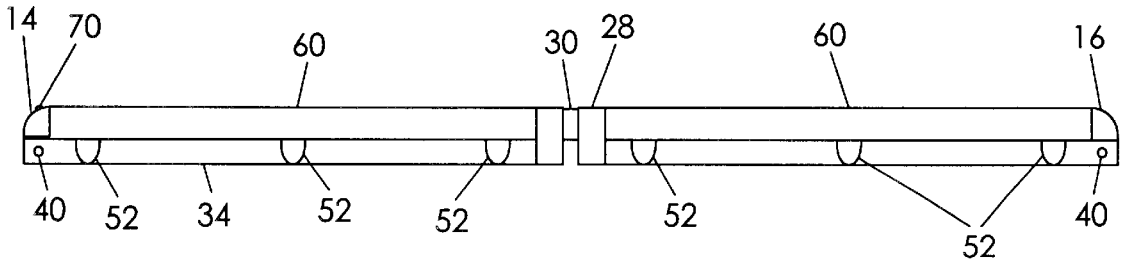
FIG. 2*b* is a front view of the lighting apparatus as in FIG. 1.
Figure 3A:
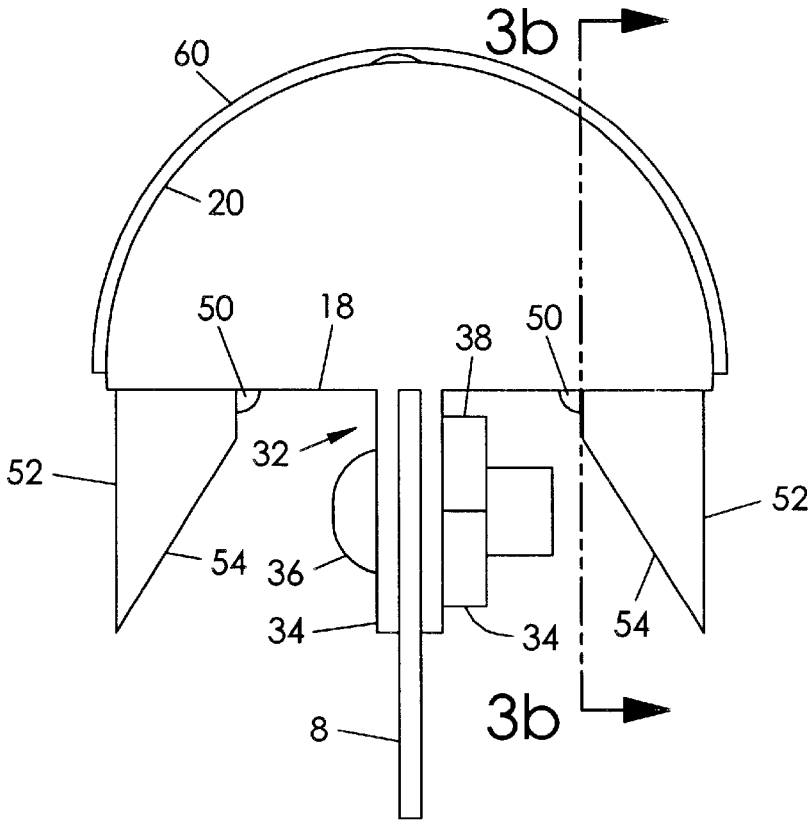
FIG. 3*a* is a side view on an enlarged scale of the lighting apparatus as in FIG. 2*b;*
Figure 3B:
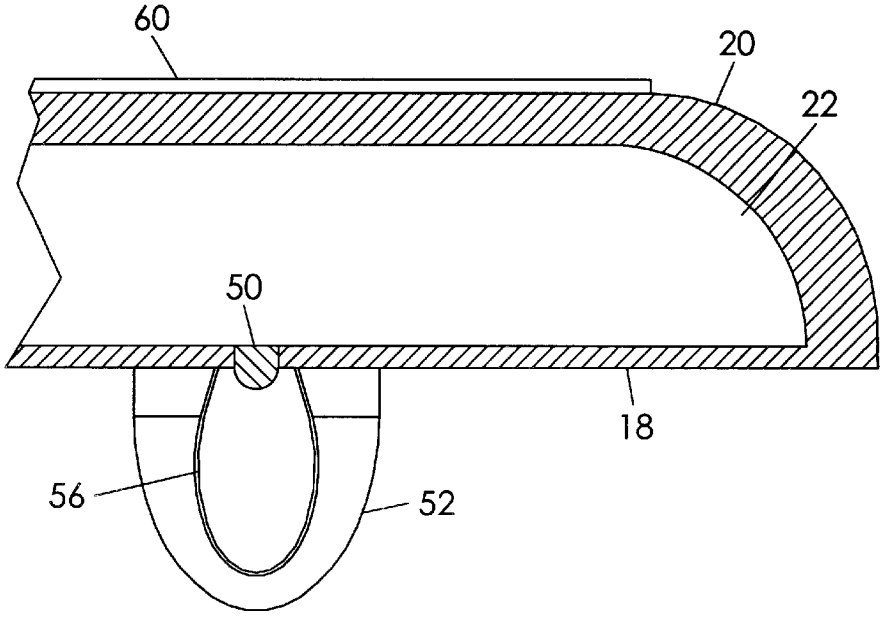
FIG. 3*b* is a sectional view of the lighting apparatus taken along line 3*b*—3*b* of FIG. 3*a;*

A lighting apparatus according to the present invention will now be described in detail with reference to FIGS. 1 through 6 of the accompanying drawings. A lighting apparatus 10 according to one embodiment (FIG. 1) includes an elongate frame 12 having a planar bottom 18 with an upper portion 20 extending upwardly from the bottom 18, the upper portion having a generally inverted U-shaped or hemispherical configuration (FIG. 3*a*). The bottom 18 and upper portion 20 cooperate to define an interior space 22 for holding other components as to be described below. Although the frame 12 preferably presents an integral construction, it may include first 24 and second 26 sections with inward ends of the sections being connected with a frame member 28 (FIG. 2). The frame member 28 integrally connecting the frame sections defines a slot 30 or notch for receiving conventional means for hanging a name identification sign 7 (a name plate) from a framework (not shown) such as conventional framework for overhead stoplights. The frame 12 includes first 14 and second 16 ends which correspond to respective free ends of the first 24 and second 26 sections.

The lighting apparatus 10 further includes a bracket 32 normal to the bottom 18 of the frame 12 and normal thereto such that the frame 12 may be selectively coupled to the upper edge 9 of a name plate sign 7. More particularly, the bracket 32 includes a pair of slightly spaced apart plates 34 between which a name plate 8 may be sandwiched (FIG. 3*a*). The plates 34 extend longitudinally along the frame bottom 18. An upper edge 9 of a name plate 8 may be inserted in between the plates 34 and slidably positioned therein. The plates 34 may be releasably fastened to the name plate 8 with a conventional fastener such as a bolt 36 and nut 38 combination, pin, or the like extending through an aperture 40 defined by the bracket plates 34. Of course, the frame 12 may be coupled to a name plate 8 at the point of manufacture using more permanent attachment means such as rivets or even welding.

Figure 6:
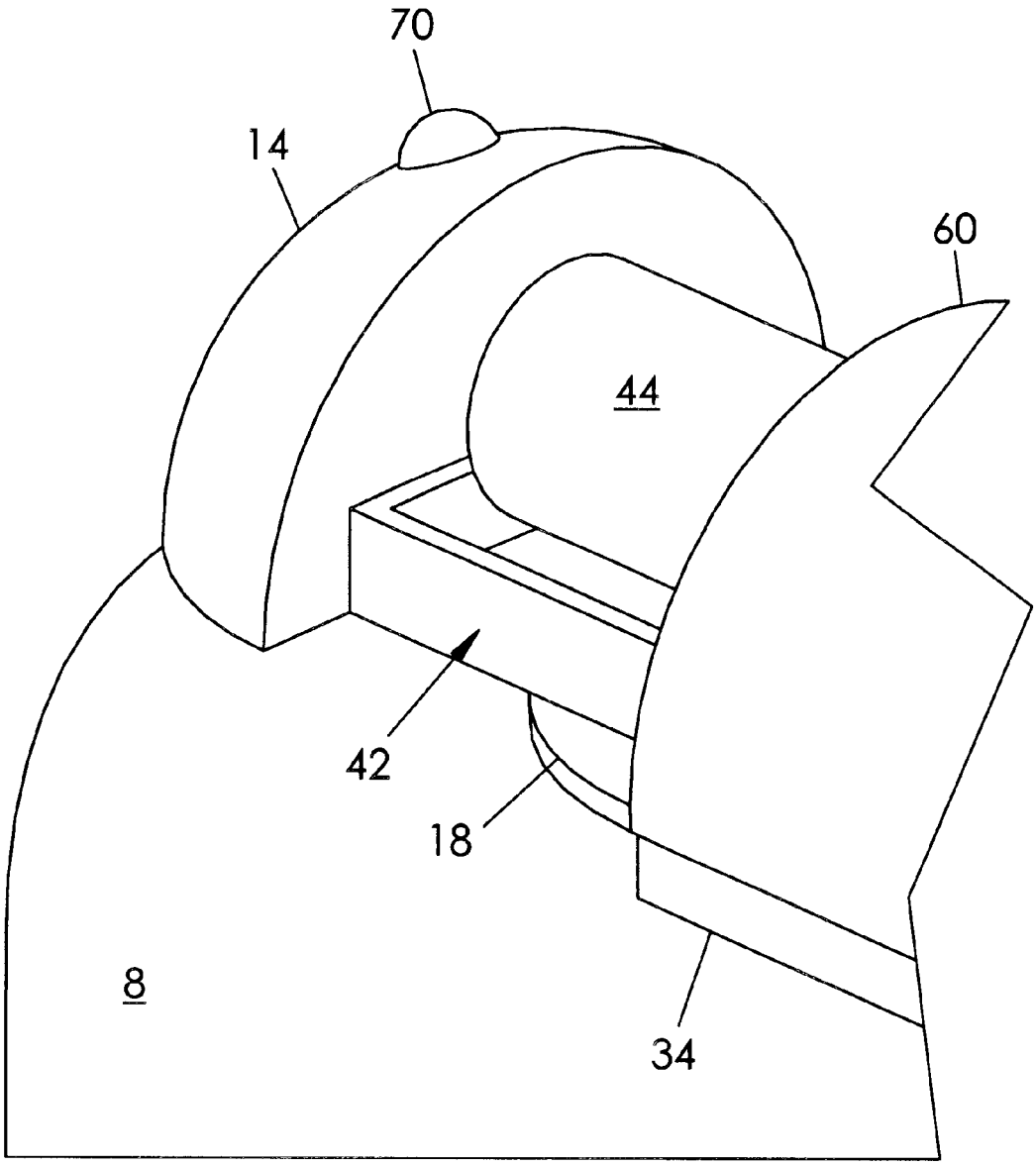
FIG. 6 is a fragmentary perspective view on an enlarged scale of a battery drawer of the lighting apparatus as in FIG. 1.

The first end 14 of the frame 12 is fixedly attached to a battery drawer 42 which is slidably coupled to an inner surface of the upper portion 20 of the frame 12. Obviously, the upper portion 20 provides an opening at that end such that the drawer 42 may be slidably moved between an extended configuration (FIG. 6) and a retracted configuration (FIG. 1). The battery drawer 42 includes a bottom with surrounding side walls and defines an open top such that a battery 44 may be positioned in the drawer 42 (FIG. 6). Preferably, the battery 44 is a rechargeable battery as to be described further below.

The lighting apparatus 10 further includes a plurality of light sources 50, each having an associated light housing 52. Preferably, each light source 50 is a light emitting diode although incandescent or other miniature lights would also be suitable. Each light source 50 is electrically connected to the battery 44. The light housings 52 and associated light sources 50 are attached to the outer surface of the planar bottom 18 and are spaced apart longitudinally therealong on either or both sides of the bracket plates 34. Therefore, the light apparatus 10 may illuminate both sides of a name identification sign 7 to which it is coupled. Each light housing 52 surrounds a respective light source 50 and includes an opaque outer wall defining a cutout 54 configured to direct light from the light source 50 toward the name plate 8 being held by a bracket 32 (FIG. 3*a*).

Further, a reflector plate 56 is positioned within each light housing 52 such that light from a respective light source is reflected onto the name plate 8 rather than being absorbed or inefficiently directed.

The lighting apparatus 10 further includes a solar panel 60 having a configuration substantially similar to that of the upper portion 20 of the frame 12 so as to be mounted atop the upper portion 20 and substantially cover it. Although other types of solar panels would also be suitable, a thin film solar panel is preferred because it includes a vapor deposition, namely a thin coating of layers of silicon and metalized materials which are scribed by a laser into the individual series-connected solar cells. This provides a very efficient yet compact manner of collecting solar energy. The solar panel 60 is electrically connected to the battery 44 for providing a trickle charge thereto so as to repeatedly recharge the battery 44. It should be appreciated that a solar power is not an essential source for electrical energy. A conventional battery could alternately be used or even AC energy where available.

A photoelectric light switch including a photoelectric light sensor 70, commonly referred to as an "electric eye", is mounted to the first end 14 of the frame 12 (FIGS. 1 and 6) and is electrically connected to the rechargeable battery 44. The light sensor 70 is electrically connected to the battery 44 in such that current is permitted to energize the light sources 50 only when the light sensor 70 detects a level of ambient light that is below a predetermined light level. It is understood that the lighting apparatus 10 could function without a light sensor 70 or even if the light sensor is not functioning. In other words, the light sources 50 may be constantly energized by the battery 44 or a manual on/off switch may be employed.

In use, the frame 12 may be coupled to a previously existing street intersection sign or fixedly mounted to a new sign having a relatively thin name plate 8. To mount a name plate 8 within the bracket 32 of the frame 12, the name plate may be inserted therein and then slidably moved longitudinally along the channel defined between the bracket plates 34. Once positioned, the frame 12 may be releasably secured thereto with a fastener, such as a bolt 36. The solar panel 60 is adapted to collect solar energy during periods of sunlight and to recharge the battery 44 accordingly. During periods of darkness (or if no solar panel is provided or if it is non-functional), the plurality of light sources 50 may be energized with current stored in the battery 44. This current is provided when the light sensor 70 detects an ambient light level that is below a predetermined level.

Figure 4:
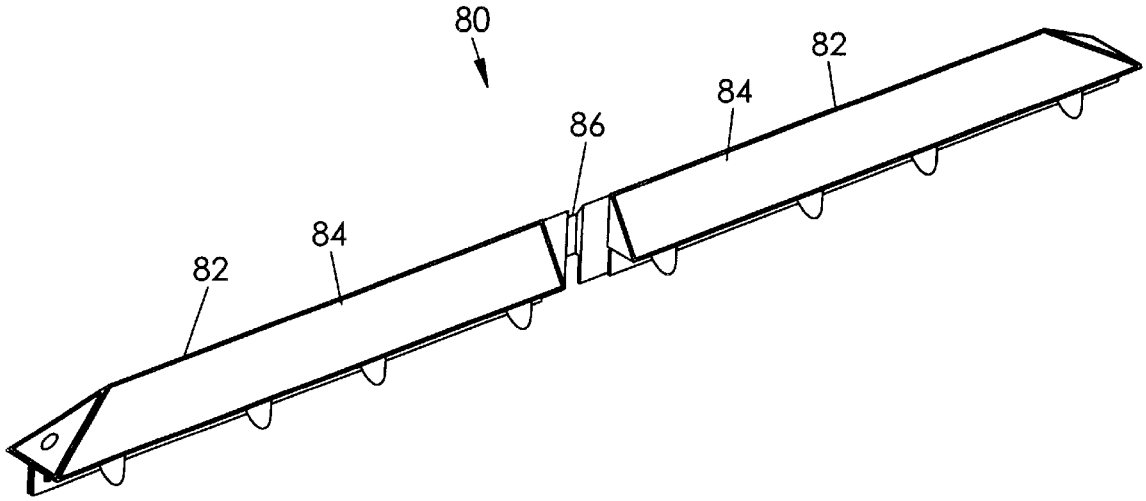
FIG. 4 is a perspective view of a lighting apparatus according to another embodiment of the present invention.

Another embodiment 80 of the present invention is shown in FIG. 4 and has a construction substantially similar to that described above except as specifically noted below. The upper portion 82 of the frame includes an inverted V-shaped configuration and the device includes flat solar panels 84 configured to substantially overlay the upper portion 82. The frame member 86 connecting sections of the frame also includes a slightly different configuration but otherwise fulfills the same utility function described above.

Figure 5:
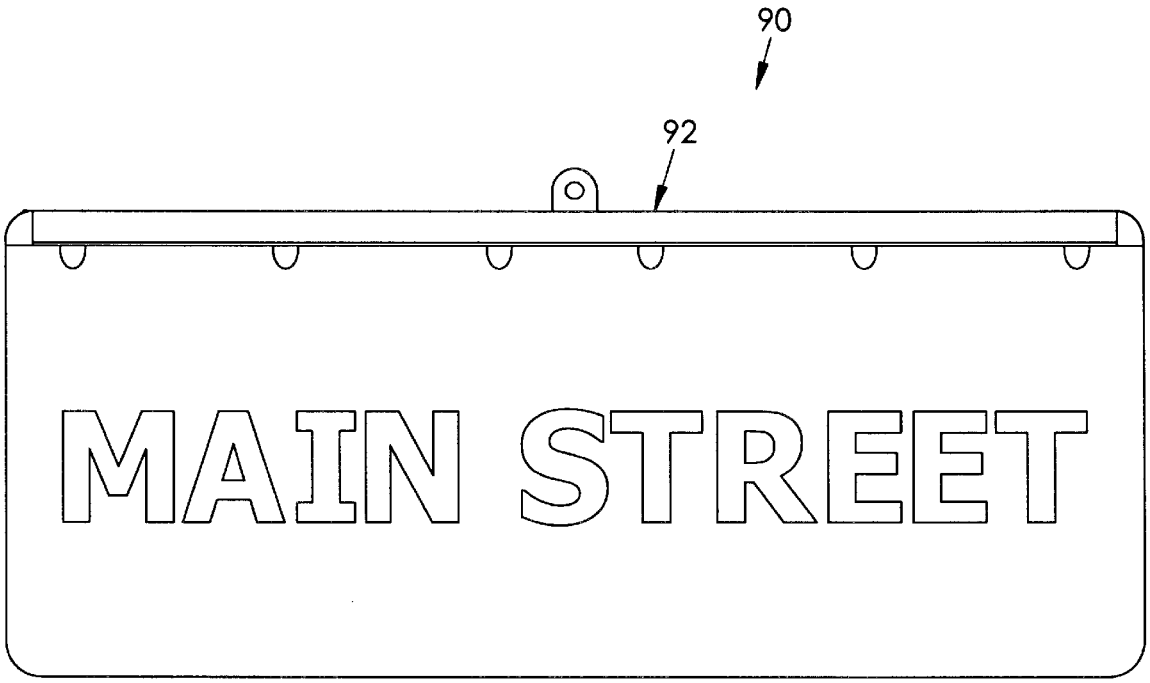
FIG. 5 is a front view of a lighting apparatus according to still another embodiment of the present invention installed upon a street identification sign.

Another embodiment 90 of the present invention is shown in FIG. 5 and includes a construction substantially similar to that of the embodiment first described above except as specifically noted below. In this embodiment, the frame 92 includes a unitary longitudinal construction that does not define a vertical slot between opposed ends. In other words, this embodiment 90 is more suitable for attachment to street signs that are not hung from a signage framework.

Still another embodiment (not shown) includes a pair of elongate brackets which extend longitudinally along the bottom of the frame. These brackets are adapted to be coupled to a pair of sign plates in the manner previously described such that the plates in essence form walls depending from the frame. Each sign plate may include a translucent construction such that the light sources mounted to the frame bottom illuminate both plates.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A lighting apparatus for use in illuminating a sign of a type having an elongate name plate with an upper edge, said lighting apparatus comprising:

an elongate frame having a configuration adapted to engage the upper edge of the name plate;

a solar panel attached to said frame and extending longitudinally therealong for collecting solar energy;

a rechargeable battery electrically connected to said solar panel in a manner to recharge said battery; and a plurality of light sources mounted to said frame and spaced apart longitudinally therealong, said plurality of light sources being electrically connected to said battery whereby to illuminate the name plate.

2. The lighting apparatus as in claim 1 wherein said frame includes a planar bottom with an inverted generally U-shaped upper portion extending upwardly from said bottom and defining an interior space, said frame including a bracket having a pair of spaced apart plates extending longitudinally therealong and adapted to sandwich the name plate therebetween.

3. The lighting apparatus as in claim 2 wherein said solar panel is a thin film solar panel attached to said upper portion of said frame and having a configuration complementary thereto.

4. The lighting apparatus as in claim 1 wherein said frame includes opposed first and second ends and defines a vertically disposed slot between said first and second ends, said slot adapted to receive means for hanging said sign from a sign framework.

5. The lighting apparatus as in claim 2 further comprising a battery drawer coupled to said frame for holding said rechargeable battery, said drawer being slidably movable longitudinally in said interior space of said frame between a first configuration extended from said frame and a second configuration retracted within said interior space of said frame.

6. The lighting apparatus as in claim 1 further comprising a light sensor mounted to said frame for sensing a level of ambient light, said light sensor permitting current from said battery to energize said plurality of light sources when said sensed level of ambient light is below a predetermined level.

7. The lighting apparatus as in claim 1 wherein each light source is a light emitting diode.

8. The lighting apparatus as in claim 7 further comprising a reflective plate positioned adjacent each light emitting diode for reflecting light onto the name plate.

9. A lighting apparatus for use with a sign of a type having an elongate name plate, said lighting apparatus comprising:

an elongate frame having a planar bottom with a generally arcuate upper portion defining an open space between said bottom and said upper portion;

a bracket having a pair of spaced apart plates extending longitudinally along said planar bottom and adapted to sandwich a portion of the name plate therebetween;

a battery positioned within said frame; and a plurality of light sources mounted to said bottom of said frame and spaced apart longitudinally therealong, said plurality of light sources being electrically connected to said battery, whereby to illuminate the name plate.

10. The lighting apparatus as in claim 9 further comprising a solar panel positioned atop said upper portion of said frame for collecting solar energy, said solar panel being electrically connected to said battery for providing a trickle charge to said battery, whereby to repeatedly recharge said battery.

11. The lighting apparatus as in claim 10 wherein said solar panel is a thin film solar panel attached to an outer surface of said upper portion of said frame and having a configuration complementary therewith.

12. The lighting apparatus as in claim 10 further comprising a photoelectric light sensor mounted to said frame for sensing a level of ambient light, said light sensor permitting current from said battery to energize said plurality of light sources when said sensed level of ambient light is below a predetermined level.

13. The lighting apparatus as in claim 9 further comprising a photoelectric light sensor mounted to said frame for sensing a level of ambient light, said light sensor permitting current from said battery to energize said plurality of light sources when said sensed level of ambient light is below a predetermined level.

14. The lighting apparatus as in claim 9 wherein said frame includes first and second portions, said first and second portion being connected with a frame member defining a vertically disposed slot adapted to receive means for hanging said sign from a sign framework.

15. The lighting apparatus as in claim 9 further comprising a battery drawer coupled to said frame for holding said battery, said drawer being slidably movable longitudinally in said interior space of said frame between a first configuration extended from said frame and a second configuration retracted within said interior space of said frame.

16. The lighting apparatus as in claim 9 wherein each of said plurality of light sources is a light emitting diode.

17. The lighting apparatus as in claim 9 further comprising a plurality of reflective plates, each reflective plate being positioned relative to a respective light source so as to reflect light onto the name plate of the sign when said frame is coupled to the sign.

18. A lighting apparatus for use in illuminating a sign of a type having an elongate name plate with an upper edge, said lighting apparatus comprising:

an elongate frame having a planar bottom with a generally arcuate upper portion defining an open space between said bottom and said upper portion;

a bracket having a pair of spaced apart plates extending longitudinally along said planar bottom and adapted to sandwich a portion of the name plate therebetween adjacent the upper edge thereof;

means for releasably coupling said bracket to the name plate;

a rechargeable battery positioned within said interior space;

a solar panel positioned atop said upper portion of said frame for collecting solar energy, said solar panel being electrically connected to said battery for providing a trickle charge to said battery, whereby to repeatedly recharge said battery;

a plurality of light sources depending from said bottom of said frame and spaced apart longitudinally therealong and positioned on both sides of said bracket; and a photoelectric light sensor mounted to said frame for sensing a level of ambient light, said light sensor being electrically connected to said battery and adapted to permit current from said battery to energize said plurality of light sources when said sensed level of ambient light is below a predetermined level.

19. The lighting apparatus as in claim 18 further comprising a reflective plate positioned adjacent each light source for reflecting light onto the name plate.

20. The lighting apparatus as in claim 18 wherein said solar panel is a thin film solar panel substantially overlaying said upper portion of said frame.

* * * * *